US011319945B2

(12) United States Patent
Zhang et al.

(10) Patent No.: US 11,319,945 B2
(45) Date of Patent: May 3, 2022

(54) ELASTOMERIC-HOSE-COMPRESSING PART, CARTRIDGE, AND ROLLER ASSEMBLY FOR PUMP HEAD OF A PERISTALTIC PUMP

(71) Applicant: Baoding Lead Fluid Technology Co., Ltd., Hebei (CN)

(72) Inventors: Yanfeng Zhang, Hebei (CN); Minghui Zhang, Hebei (CN); Penghao Li, Hebei (CN)

(73) Assignee: Baoding Lead Fluid Technology Co., Ltd, Baoding (CN)

( * ) Notice: Subject to any disclaimer, the term of this patent is extended or adjusted under 35 U.S.C. 154(b) by 111 days.

(21) Appl. No.: 16/706,240

(22) Filed: Dec. 6, 2019

(65) Prior Publication Data

US 2020/0208625 A1 Jul. 2, 2020

(30) Foreign Application Priority Data

Dec. 26, 2018 (CN) ..... 201811605118.1
Dec. 26, 2018 (CN) ..... 201822203295.9

(51) Int. Cl.
*F04B 43/12* (2006.01)

(52) U.S. Cl.
CPC ..... *F04B 43/1253* (2013.01); *F04B 43/1284* (2013.01)

(58) Field of Classification Search
CPC ..... F04B 43/1253; F04B 43/1276; F04B 43/1284

(Continued)

(56) References Cited

U.S. PATENT DOCUMENTS 3,335,670 A * 8/1967 Williams ..... F04B 43/14 417/53
3,567,345 A * 3/1971 Ballentine ..... F04B 43/1253 417/477.3

(Continued)

FOREIGN PATENT DOCUMENTS

CH 562402 A * 5/1975
CH 562402 A5 5/1975

(Continued)

*Primary Examiner* — Nathan C Zollinger
(74) *Attorney, Agent, or Firm* — Novick, Kim & Lee, PLLC; Allen Xue

(57) ABSTRACT

Provided are an elastomeric-hose-compressing part, a cartridge, and a roller assembly for a pump head of a peristaltic pump, and a pump head for a peristaltic pump. The elastomeric-hose-compressing part includes a surface for compressing the elastomeric hose which has an arcuate shape along its length direction, wherein the surface for compressing the elastomeric hose is provided with flanges oppositely arranged on two side portions of the elastomeric-hose-compressing part in the width direction, the width direction of the elastomeric-hose-compressing part is perpendicular to the length direction, and the surface for compressing the elastomeric hose is formed by a continuous surface or by a plurality of surfaces sequentially arranged along the length direction. By providing flanges at two sides of the surface for compressing the elastomeric hose, the elastomeric-hose-compressing part as disclosed may reliably limit the elastomeric hose between the surface for compressing the elastomeric hose and the roller assembly of the peristaltic pump, which thus reduces abnormal abrasion of the elastomeric hose.

6 Claims, 6 Drawing Sheets

(58) Field of Classification Search
USPC ..... 417/477.1, 477.7, 477.8, 477.6, 477.11, 417/477.12
See application file for complete search history.

(56) References Cited

U.S. PATENT DOCUMENTS

| | | | | | |
|---|---|---|---|---|---|
| 4,586,882 | A * | 5/1986 | Tseng | ..... | F04B 43/1253 417/477.3 |
| 5,533,878 | A | 7/1996 | Iwata et al. | | |
| 5,915,932 | A | 6/1999 | Nabity et al. | | |
| 2018/0230988 | A1 * | 8/2018 | Fang | ..... | F04B 43/0072 |

FOREIGN PATENT DOCUMENTS

| | | | | | |
|---|---|---|---|---|---|
| DE | 3840259 | A1 * | 5/1990 | ..... | F04B 43/1284 |
| WO | 2014105755 | A1 | 7/2014 | | |
| WO | WO-2014105755 | A1 * | 7/2014 | ..... | A61M 1/1609 |
| WO | 2017129193 | A1 | 8/2017 | | |

* cited by examiner

ELASTOMERIC-HOSE-COMPRESSING PART, CARTRIDGE, AND ROLLER ASSEMBLY FOR PUMP HEAD OF A PERISTALTIC PUMP

FIELD

The present disclosure relates to peristaltic pumps, and more particularly relates to an elastomeric-hose-compressing part, a cartridge, and a roller assembly for a pump head of a peristaltic pump.

BACKGROUND

A peristaltic pump generally comprises a drive (not shown), a pump head 101 and an elastomeric hose 102, as shown in FIG. 1. Due to its advantages such as good sealing property, contamination-free, high precision, and ease for maintenance, such a structural configuration is widely applied to an array of industries including chemical engineering, metallurgy, paper making, food, petroleum, and pharmacy. When the peristaltic pump is operating, the elastomeric hose 102 is full of liquid 103, and the drive actuates, via an axle 108, the roller assembly 104 in the pump head 101 to rotate. During rotating of the roller assembly, a plurality of rollers 105 provided on the circumference of the roller assembly 104 alternately compress and relax the elastomeric hose 102 towards and off a hose-compressing block 106, thereby forming a negative pressure inside the elastomeric hose 102 to pump the liquid 103.

In particular, the elastomeric hose should have certain elasticity, such that the hose may quickly restore shape from a radial stress; further, the elastomeric hose should further have a certain abrasion resistance property and a pressure bearing capacity. Elastomeric hoses adapted to different peristaltic pumps all have corresponding service lives, such that when a peristaltic pump works for a corresponding period, the elastomeric hose needs to be replaced; otherwise, the elastomeric hose can be potentially cracked, and then liquid would leak out and flow into the roller assembly of the pump head, causing faults and damages to the equipment.

Conventionally, the hose-compressing block 106 is generally a plane compressing surface, while the rollers 105 on the roller assembly 104 are column-shaped rolls, as shown in FIG. 2. During the actual operating process of the peristaltic pump, the elastomeric hose 102 compressed between the hose-compressing block 106 and the plurality of rollers 105 might have a positional offset, a potential consequence of which is that the elastomeric hose 102 cannot be compressed tightly, affecting pumping of the liquid; further, if the elastomeric hose 102 is compressed into a space outside the hose-compressing block 106 and the plurality of rollers 105, it will contact with exterior structures of the pump head, causing damages to the hose.

SUMMARY

To solve the above technical problem, i.e., the service life of an elastomeric hose is affected by elastomer hose offset, the present disclosure provides an elastomeric-hose-compressing part, a cartridge, and a roller assembly for a pump head of a peristaltic pump, and a pump head for a peristaltic pump.

In a first aspect of the present disclosure, there is provided an elastomeric-hose-compressing part for a pump head of a peristaltic pump. The elastomeric-hose-compressing part comprises a surface for compressing the elastomeric hose which has an arcuate shape along its length direction, wherein the surface for compressing the elastomeric hose is provided with flanges oppositely arranged on two side portions of the elastomeric-hose-compressing part in the width direction, the width direction of the elastomeric-hose-compressing part is perpendicular to the length direction, and the surface for compressing the elastomeric hose is formed by a continuous surface or by a plurality of surfaces sequentially arranged along the length direction.

Further, the height h of the flange is not less than elastomeric hose wall thickness, and/or the width of the surface for compressing the elastomeric hose in the width direction of the elastomeric-hose-compressing part is greater than or equal to half of outer perimeter of a section of the elastic hose.

Further, a ratio between the height h of the flange and the width d of the flange in the width direction of the elastomeric-hose-compressing part is in a range of $2 \geq d/h \geq 1/3$.

Further, the flange has an inner sidewall, a top wall, and an outer sidewall, the top wall being formed substantially obliquely between the outer sidewall and the inner sidewall, the top wall having an arc shape that is convex relative to the surface for compressing the elastomeric hose, and a top wall portion proximal to the outer sidewall being higher than a top wall portion proximal to the inner sidewall.

Further, the width of the top wall is greater than the elastomeric hose wall thickness.

Further, between the inner sidewall and the surface for compressing the elastomeric hose is provided a joining surface with gentle transition; between the inner sidewall and the top wall is provided a joining surface with gentle transition; and/or, a section of the inner sidewall has a recessed arc shape, the curvature radius of the inner sidewall on the arc section being not less than 1 times the elastomeric hose wall thickness.

Further, the flange has an inner sidewall, a top wall, and an outer sidewall, the top wall being formed substantially obliquely between the outer sidewall and the inner sidewall, the top wall having an arc shape which is convex relative to the surface for compressing the elastomeric hose, and a top wall portion proximal to the outer sidewall being higher than a top wall portion proximal to the inner sidewall;

the inner sidewall has a recessed arc shape of not more than ¼ circumference, the radius of the arc being 1~2.5 times the elastomeric hose wall thickness, the inner sidewall being tangent with the surface for compressing the elastomeric hose.

Further, the flange has an inner sidewall and an outer sidewall, the inner sidewall being obliquely provided between the top end of the outer sidewall and the surface for compressing the elastomeric hose, the inner sidewall being of a plane shape, or a section of the inner sidewall being of a recessed arc shape, the curvature radius of the inner sidewall on the arc section being not less than 1 times the elastomeric hose wall thickness.

Further, the inner sidewall has an arc shape of not more than ¼ circumference, the radius of the arc being 1~2.5 times the elastomeric hose wall thickness, the inner sidewall being tangent with the surface for compressing the elastomeric hose.

Further, a ratio between the height h of the flange and the width d of the flange in the width direction of the elastomeric-hose-compressing part is in a range of $2 \geq d/h \geq 1/2$.

In a second aspect of the present disclosure, there is provided a cartridge for a pump head of a peristaltic pump. The cartridge comprises: a cartridge body and a snap-fitting part, wherein the cartridge body is of a ⊓ shape; at a lower side of a transverse beam of the cartridge body is provided the elastomeric-hose-compressing part according to the first aspect of the present disclosure; and the snap-fitting part is adapted to detachably mounting the cartridge to the pump head of the peristaltic pump.

In a third aspect of the present disclosure, there is provided a roller assembly for a pump head of a peristaltic pump. The roller assembly comprises: three or more rollers arranged at even intervals on the circumference of the roller assembly, the rollers being arranged on the roller assembly via a rotary shaft, the axial direction of the rollers being parallel to the axial direction of the roller assembly; the rollers rotate independently relative to the roller assembly; annular flanges which are convex along the radial direction of the rollers are oppositely arranged on two axial end portions of the rollers, such that surfaces of the rollers between the annular flanges oppositely arranged on the two axial end portions of the rollers form a surface for compressing the elastomeric hose.

Further, the height h of the flange is not less than elastomeric hose wall thickness, and/or the width of the surface for compressing the elastomeric hose along the axial direction of the roller assembly is greater than or equal to half of the outer perimeter of a section of the elastic hose.

Further, a ratio between the height h of the flange and the width d of the flange along the axial direction of the roller assembly is in a range of $2 \geq dh/h \geq 1/3$.

Further, the flange has an inner sidewall, a top wall, and an outer sidewall, the top wall being formed substantially obliquely between the outer sidewall and the inner sidewall, the top wall having an arc shape which is convex relative to the surface for compressing the elastomeric hose, and a top wall portion proximal to the outer sidewall being higher than a top wall portion proximal to the inner sidewall.

Further, the width of the top wall along the axial direction of the roller assembly is greater than the elastomeric hose wall thickness.

Further, between the inner sidewall and the surface for compressing the elastomeric hose is provided a joining surface with gentle transition; between the inner sidewall and the top wall is provided a joining surface with gentle transition; and/or, a section of the inner sidewall has a recessed arc shape, the curvature radius of the inner sidewall on the arc section being not less than 1 times the elastomeric hose wall thickness.

Further, the flange has an inner sidewall, a top wall, and an outer sidewall, the top wall being formed substantially obliquely between the outer sidewall and the inner sidewall, the top wall having an arc shape which is convex relative to the surface for compressing the elastomeric hose, and a top wall portion proximal to the outer sidewall being higher than a top wall portion proximal to the inner sidewall;

the inner sidewall has a recessed arc shape of not more than ¼ circumference, the radius of the arc being 1~2.5 times the elastomeric hose wall thickness, the inner sidewall being tangent with the surface for compressing the elastomeric hose.

Further, the flange has an inner sidewall and an outer sidewall, the inner sidewall being obliquely provided between the top end of the outer sidewall and the surface for compressing the elastomeric hose, the inner sidewall being of a plane shape, or a section of the inner sidewall being of a recessed arc shape, the curvature radius of the inner sidewall on the arc section being not less than 1 times the elastomeric hose wall thickness.

Further, the inner sidewall has an arc shape of not more than ¼ circumference, the radius of the arc being 1~2.5 times the elastomeric hose wall thickness, the inner sidewall being tangent with the surface for compressing the elastomeric hose.

Further, a ratio between the height h of the flange and the width d of the flange along the axial direction of the roller assembly is in a range of $2 \geq d/h \geq 1/2$.

In a fourth aspect of the present disclosure, there is provided a pump head for a peristaltic pump. The pump head comprises the elastomeric-hose-compressing part according to the first aspect of the present disclosure and/or the roller assembly according to the third aspect of the present disclosure, wherein the surface for compressing the elastomeric hose of the elastomeric-hose-compressing part may be fitted with the roller assembly so as to limit an elastomeric hose between the surface for compressing the elastomeric hose and the rollers of the roller assembly.

The present disclosure offers the following advantageous effects: by providing flanges at two sides of the surface for compressing the elastomeric hose fitted with the pump head, the elastomeric-hose-compressing part according to the embodiments of the present disclosure may always reliably limit the elastomeric hose between the surface for compressing the elastomeric hose and the roller assembly during operating of the peristaltic pump irrespective of whether the elastomeric hose per se is offset or whether offset of the elastomeric hose is caused by malalignment of the compressing part, which thus reduces abnormal abrasion of the elastomeric hose to thereby guarantee service life of the elastomeric hose, and reduces the frequency of replacing the elastomeric hose to thereby enhance working efficiency and reduce costs.

DETAILED DESCRIPTION OF EMBODIMENTS

Figure 1:
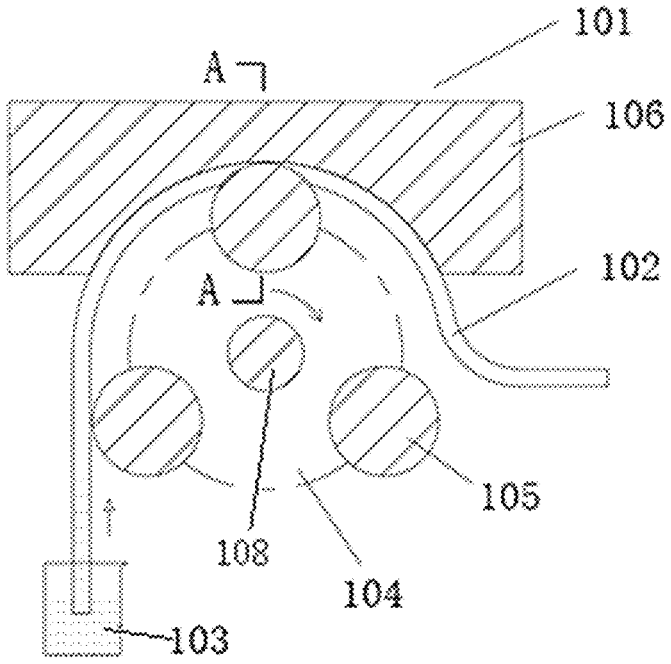
FIG. 1 shows a structural schematic diagram of a conventional peristaltic pump.

To make the objects, technical solutions, and advantages of the present disclosure much clearer, the present disclosure will be further described in detail through the preferred embodiments in conjunction with the accompanying drawings. However, those skilled in the art should know that the present disclosure is not limited to the drawings and the embodiments.

In the embodiments of the present disclosure, unless otherwise indicated, the orientation terms such as "upper, lower" are generally used with respect to the drawings. The orientations "upper, lower" are termed with respect to the vertical, perpendicular, or gravitational direction; meanwhile, to ease the understanding and description, the orientations "left, right" refer to the left and the right shown in the drawings; the orientations "inner, outer" refer to inside and outside the outline of respective component per se; however, the above orientation expressions are not used for limiting the present disclosure.

Embodiment 1

Figure 3:
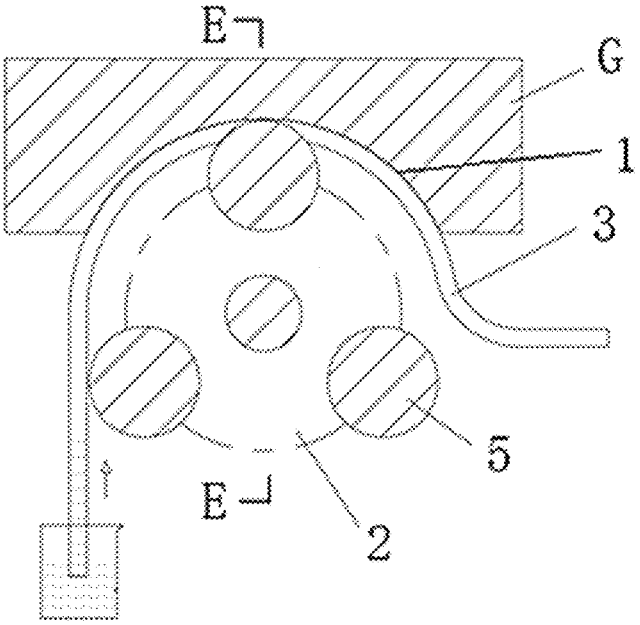
FIG. 3 shows a structural schematic diagram of a pump head of a peristaltic pump with an elastomeric-hose-compressing part G according to an embodiment of the present disclosure.

An embodiment of the present disclosure provides an elastomeric-hose-compressing part for a power head of a peristaltic pump. As shown in FIG. 3, the orientations "upper, lower" refer to the directions as shown in FIG. 3 or are termed with respect to the vertical, perpendicular, or gravitational direction; meanwhile, to ease the understanding and description, the orientations "left, right" refer to the left and the right shown in the drawings; the orientations "inner, outer" refer to inside and outside the outline of respective component per se; however, the above orientation expressions are not used for limiting the present disclosure. An elastomeric-hose-compressing part G for a power head of a peristaltic pump comprises a surface 1 for compressing the elastomeric hose having an arcuate shape along its length direction (the left-right direction in FIG. 3), and the surface 1 for compressing the elastomeric hose may be fit with a roller assembly 2 of the pump head to compress the elastomeric hose 3 to thereby pump liquid. The surface 1 for compressing the elastomeric hose may be a continuous surface, or formed by a plurality of surfaces sequentially arranged along the length direction. In particular, the arcuate surface 1 for compressing the elastomeric hose may be a smooth surface or an approximately smooth surface formed by continuous straight-line segments.

Figure 4:
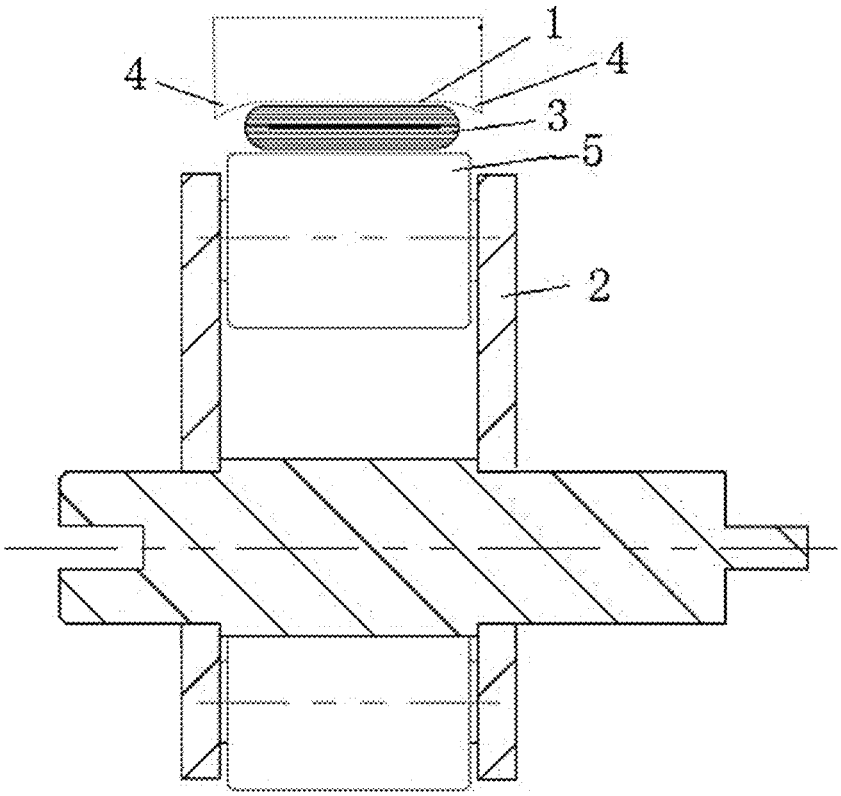
FIG. 4 shows a sectional view of the pump head with the elastomeric-hose-compressing part G along the sectional line E-E in FIG. 3.

As shown in FIG. 4, flanges 4 are oppositely provided on two side edges of the surface 1 for compressing the elastomeric hose in the width direction (the left-right direction in FIG. 4) of the elastomeric-hose-compressing part G, wherein the width direction of the elastomeric-hose-compressing part G is vertical to the length direction; the height f of the flange 4 is preferably not less than the elastomeric hose wall thickness 3; a ratio between the height h of the flange 4 and the width d of the flange 4 in the width direction of the elastomeric-hose-compressing part G is preferably in a range of $2 \geq d/h \geq 1/3$. Besides, those skilled in the art should understand that the width of the surface 1 for compressing the elastomeric hose in the width direction of the elastomeric-hose-compressing part G is greater than or equal to half of outer perimeter of a section of the elastic hose. As such, the surface 1 for compressing the elastomeric hose may be fitted with the roller assembly 2 to limit an elastomeric hose between the surface 1 for compressing the elastomeric hose and the rollers 5 of the roller assembly 2.

Figure 5:
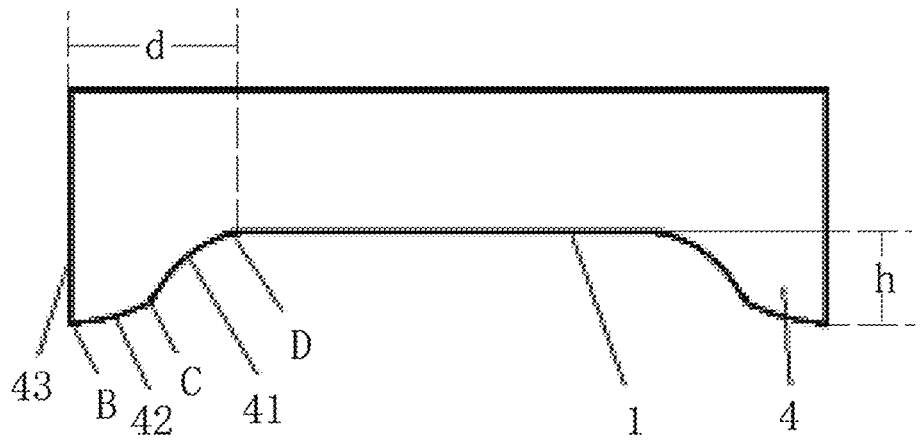
FIG. 5 shows a schematic diagram of an elastomeric-hose-compressing part G for a pump head of a peristaltic pump according to an embodiment of the present disclosure.

In an embodiment of the present disclosure, as shown in FIG. 5, the flange 4 comprises an inner sidewall 41, a top wall 42, and an outer sidewall 43, wherein the inner sidewall 41 and the surface 1 for compressing the elastomeric hose are intersected at a first edge D of the flange 4, the inner sidewall 41 and the top wall 42 are intersected at a second edge C of the flange 4, and the outer sidewall 43 and the top wall 42 are intersected at a third edge B of the flange 4.

The top wall 42 is formed substantially obliquely between the outer sidewall 43 and the inner sidewall 42, the top wall 42 having an arc shape which is convex relative to the surface 1 for compressing the elastomeric hose, and the portion of the top wall 42 proximal to the outer sidewall 43 is higher than the portion of the top wall proximal to the inner sidewall, i.e., the third edge B of the flange 4 has the highest height (which is also the height h of the flange 4). A ratio between the height h of the flange 4 and the width d of the flange 4 in the width direction of the elastomeric-hose-compressing part G is in a range of $2 \geq d/h \geq 1/3$.

In this embodiment, the width of the top wall 42 (i.e., the distance from the second edge C of the flange 4 to the outer sidewall 43 in FIG. 4) is greater than the elastomeric hose wall thickness. Further, preferably, between the inner sidewall 41 and the surface 1 for compressing the elastomeric hose is provided a joining surface with gentle transition, and between the inner sidewall 41 and the top wall 42 is provided a joining surface with gentle transition; a section of the inner sidewall 41 has a recessed arc shape. Preferably, the curvature radius of the inner sidewall 41 on the arc section is not less than 1 times the elastomeric hose wall thickness. Further, the section of the inner sidewall 41 is of an arc shape of not more than ¼ circumference; the radius of the arc is 1.2~2.5 times the elastomeric hose wall thickness; the inner sidewall 41 is tangent with the surface 51 for compressing the elastomeric hose; therefore, during operation of the peristaltic pump, if the elastomeric hose offsets towards one side, the arc-shape inner sidewall 41 can envelop the elastomeric hose better so as to block offset of the elastomeric hose, thereby reducing abrasion to the elastomeric hose.

Figure 6:
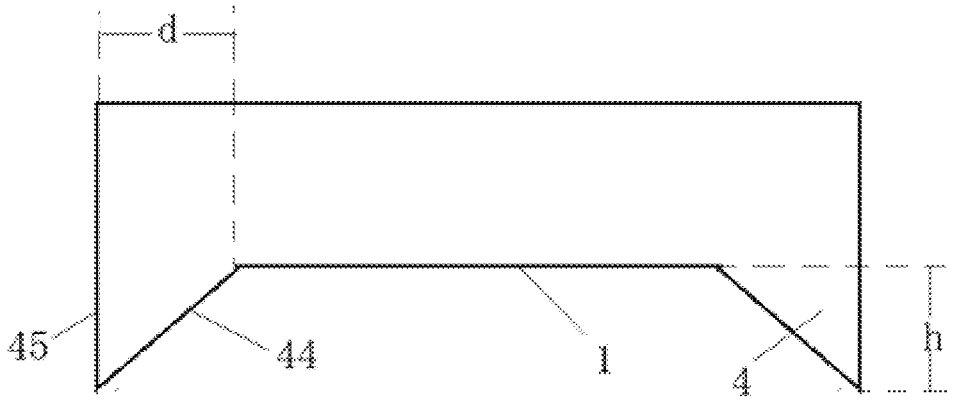
FIG. 6 shows a schematic diagram of an elastomeric-hose-compressing part G for a pump head of a peristaltic pump according to another embodiment of the present disclosure.

In another embodiment of the present disclosure, as shown in FIG. 6, the flange 4 has an inner sidewall 44 and an outer sidewall 45, the inner sidewall 44 being obliquely disposed between the top end of the outer sidewall 45 and the surface 1 for compressing the elastomeric hose. The inner sidewall 44 is of a plane shape; alternatively, the section of the inner sidewall 44 is of a recessed arc shape. Preferably, the curvature radius of the inner sidewall 44 on the arc section is not less than 1 times the elastomeric hose wall thickness. A ratio between the height h of the flange 4 and the width d of the flange 4 in the width direction of the elastomeric-hose-compressing part G is in a range of $2 \geq d/h \geq 1/2$.

Preferably, the section of the inner sidewall 44 is of an arc shape of not more than ¼ circumference, wherein the radius of the arc being 1.2~2.5 times the elastomeric hose wall thickness, and the inner sidewall 44 is tangent with the surface 1 for compressing the elastomeric hose. As such, during operation of the peristaltic pump, if the elastomeric hose offsets towards one side, the arc-shape inner sidewall 44 can envelop the elastomeric hose better so as to block offset of the elastomeric hose, thereby reducing abrasion to the elastomeric hose.

Embodiment 2

Figure 7:
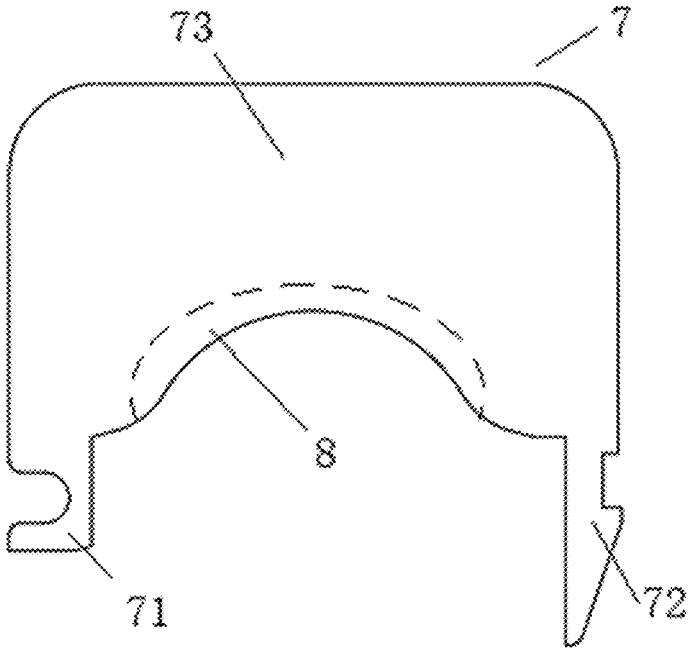
FIG. 7 shows a schematic diagram of a cartridge for a pump head of a peristaltic pump according to an embodiment of the present disclosure.
Figure 8:
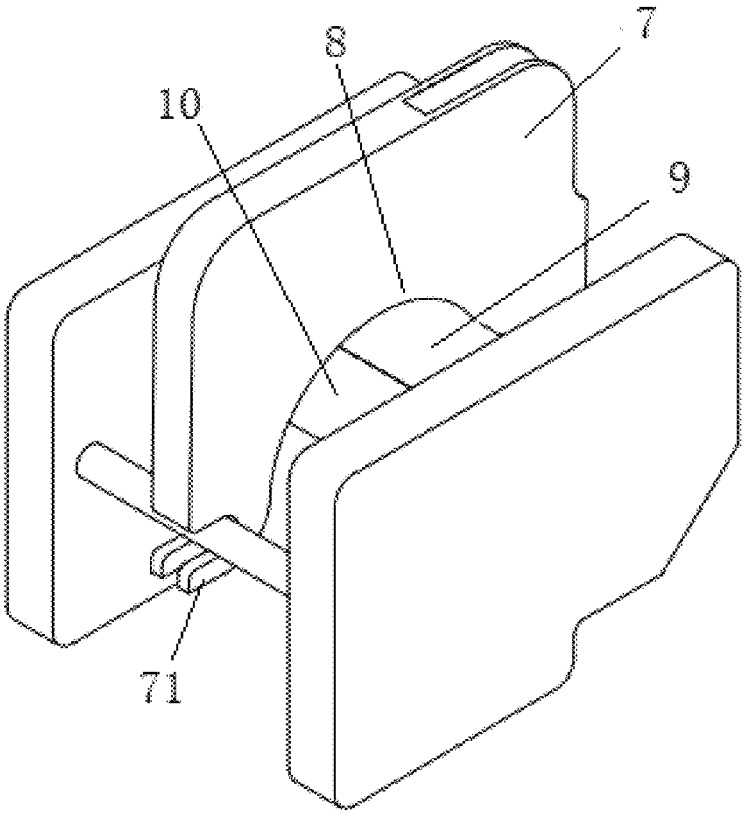
FIG. 8 shows a schematic diagram of a pump head mounted with the cartridge according to an embodiment of the present disclosure.

As illustrated in FIGS. 7 and 8, an embodiment of the present disclosure further provides a cartridge for a pump head of a peristaltic pump. The cartridge comprises: a cartridge body 7, wherein the cartridge body 7 has a ⌊⌋ shape, two sides of which are each provided with a snap-fitting part 71, 72; at a lower side of a transverse beam 73 of the cartridge body 7 is provided the elastomeric-hose-compressing part G as described above; and the cartridge body 7 is detachably mounted to the pump head via the snap-fitting parts 71, 72 disposed at the two sides.

Specifically, in this embodiment, the detachable cartridge further comprises a tubing-compressing arcuate plate 8 that is mounted at the lower side of the transverse beam 73 of the cartridge body 7; the tubing-compressing arcuate plate 8 is provided with the elastomeric-hose-compressing part as described above, wherein the surface 1 for compressing the elastomeric hose may be fit with the roller assembly 9 so as to limit the elastomeric hose between the surface for compressing the elastomeric hose and the rollers 10 of the roller assembly of the peristaltic pump.

Embodiment 3

Figure 9:
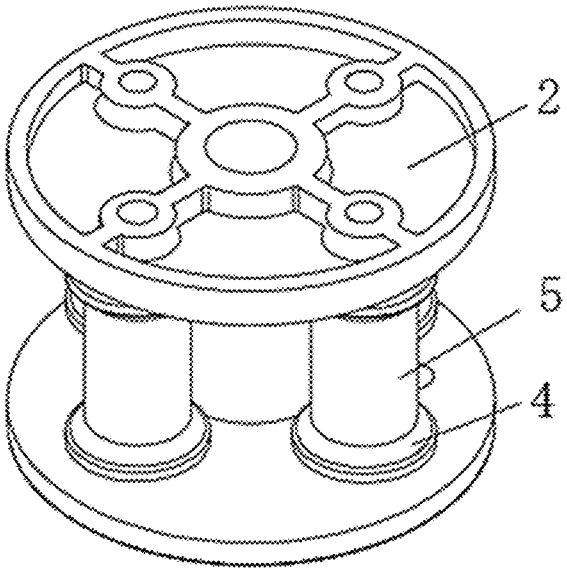
FIG. 9 shows a stereoscopic diagram of a roller assembly for a pump head of a peristaltic pump according to an embodiment of the present disclosure.
Figure 10:
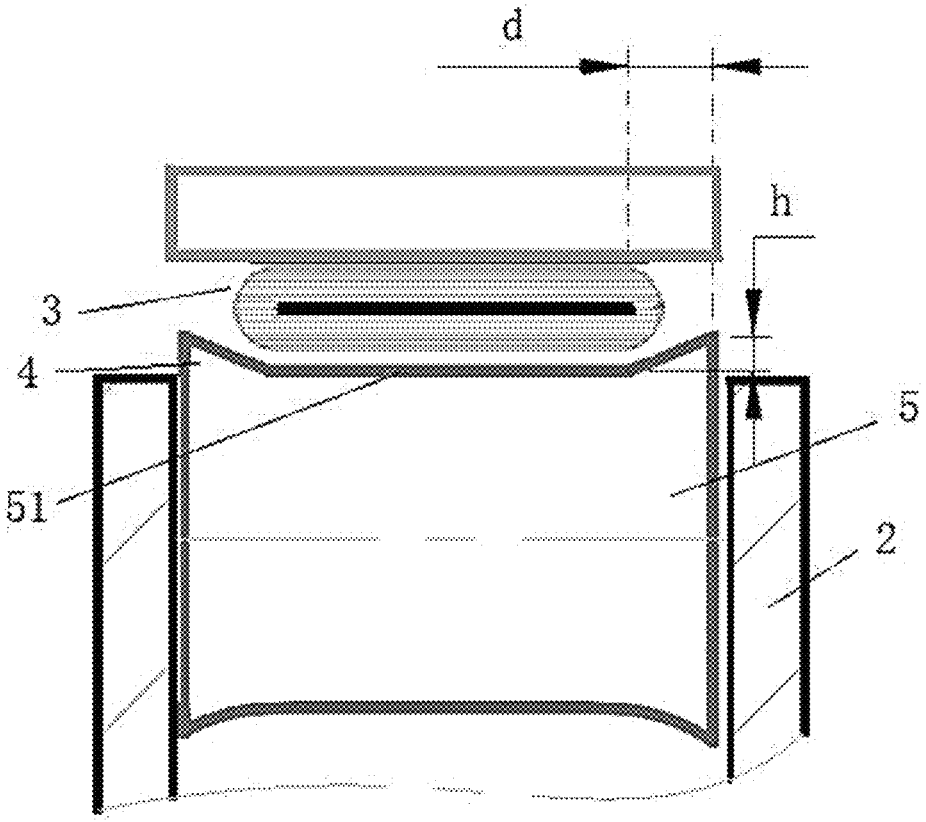
FIG. 10 shows a partial sectional view of the pump head with the roller assembly shown in FIG. 9 along the sectional line E-E in FIG. 3.

An embodiment of the present disclosure further provides a roller assembly 2 for a pump head of a peristaltic pump. As shown in FIGS. 9 and 10, on the circumference of the roller assembly 2 are arranged three or more rollers 5 at even intervals, wherein the rollers 5 are arranged on the roller assembly 2 via a rotary shaft; the axial direction of the rollers 5 is parallel to the axial direction of the roller assembly 2; the rollers 5 rotate independently relative to the roller assembly 2; annular flanges 4 which are convex radially along the rollers 5 are oppositely provided on two axial ends of the rollers 5, and surfaces of the rollers 5 between the annular flanges 4 oppositely provided on the two axial ends of the rollers 5 form a surface 51 for compressing the elastomeric hose.

Figure 11:
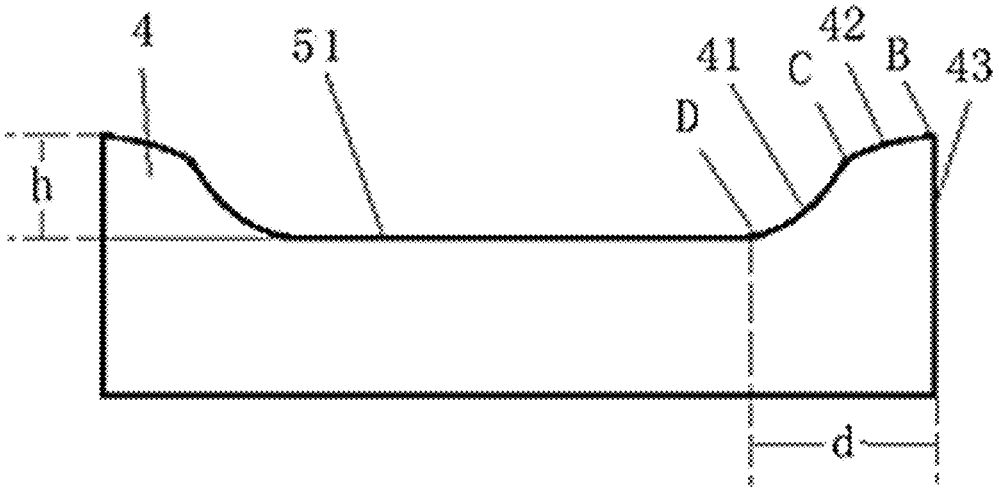
FIG. 11 shows a sectional view of a roller of a roller assembly for a pump head of a peristaltic pump according to an embodiment of the present disclosure.
Figure 12:
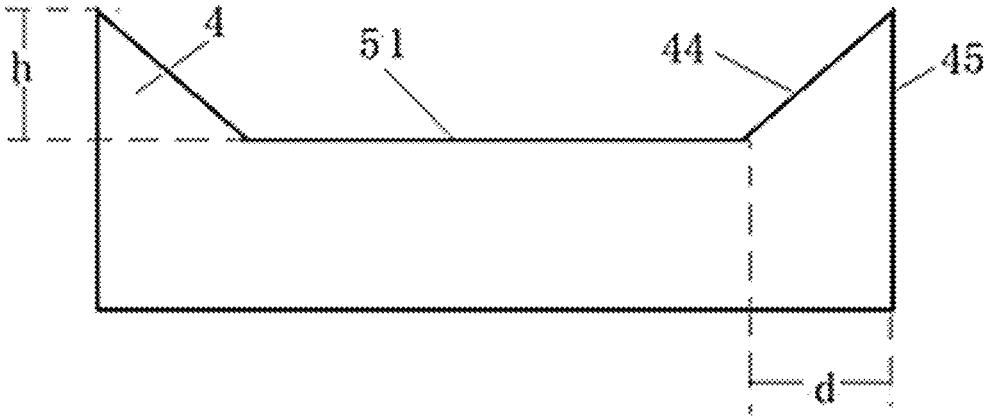
FIG. 12 shows a sectional view of a roller of a roller assembly for a pump head of a peristaltic pump according to another embodiment of the present disclosure.

In particular, as shown in FIGS. 10, 11, and 12, the height h of the flange 4 is preferably not less than the wall thickness of an elastomeric hose 3, and/or the width of the surface 51 for compressing the elastomeric hose along the axial direction of the roller assembly is greater than or equal to half of the outer wall perimeter of the elastomeric hose.

As shown in FIG. 11, in an embodiment of the present disclosure, the flange 4 comprises an inner sidewall 41, a top wall 42, and an outer sidewall 43, wherein the inner sidewall 41 and the surface 51 for compressing the elastomeric hose are intersected at a first edge D of the flange 4, the inner sidewall 41 and the top wall 42 are intersected at a second edge C of the flange 4, and the outer sidewall 43 and the top wall 42 are intersected at a third edge B of the flange 4. The top wall 42 is formed substantially obliquely between the outer sidewall 43 and the inner sidewall 41, the top wall 42 having an arc shape which is convex relative to the surface 51 for compressing the elastomeric hose, and the portion of the top wall 42 proximal to the outer sidewall 43 being higher than the portion of the top wall 42 proximal to the inner sidewall 41. The width of the top wall 42 along the axial direction of the roller assembly is preferably greater than the elastomeric hose wall thickness. Between the inner sidewall 41 and the elastomeric house compressing surface 51 is provided a joining surface with gentle transition, between the inner sidewall 41 and the top wall 42 is provided a joining surface with a gentle transition, and/or, a section of the inner sidewall 41 has a recessed arc shape. Preferably, the curvature radius of the inner sidewall 41 on the arc section is not less than 1 times the elastomeric hose wall thickness. Further, the section of the inner sidewall 41 is of an arc shape of not more than ¼ circumference, the radius of the arc is 1.2~2.5 times the elastomeric hose wall thickness, and the inner sidewall 41 is tangent with the surface 51 for compressing the elastomeric hose. And/or, a ratio between the height h of the flange 4 and the width d of the flange 4 along the axial direction of the roller assembly is in a range of $2 \geq d/h \geq 1/3$.

In another embodiment, as shown in FIG. 12, the flange 4 has an inner sidewall 44 and an outer sidewall 45, the inner sidewall 44 being obliquely provided between the top end of the outer sidewall 45 and the surface 51 for compressing the elastomeric hose, the inner sidewall 44 being of a plane shape, or a section of the inner sidewall 44 being of a recessed arc shape. Preferably, the curvature radius of the inner sidewall 44 on the arc section is not less than 1 times the elastomeric hose wall thickness. Further, the section of the inner sidewall 44 is of an arc shape of not more than ¼ circumference, the radius of the arc is 1.2~2.5 times the elastomeric hose wall thickness, and the inner sidewall 44 is tangent with the surface 51 for compressing the elastomeric hose. And/or, a ratio between the height h of the flange 4 and the width d of the flange 4 along the axial direction of the roller assembly is in a range of $2 \geq d/h \geq 1/2$.

An embodiment of the present disclosure further provides a pump head for a peristaltic pump, comprising the elastomeric-hose-compressing part as described above and/or the roller assembly as described above.

Comparison Between Technical Effects

Figure 2:
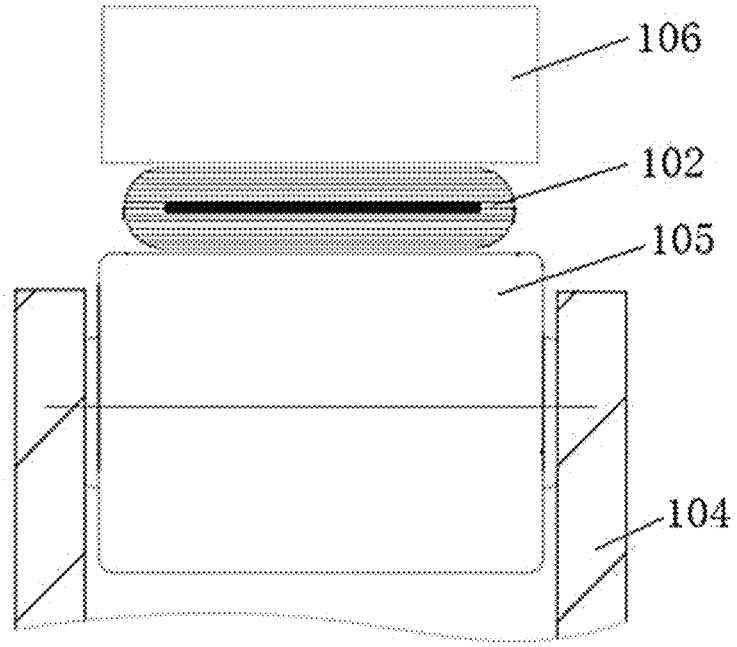
FIG. 2 shows a partial sectional view of a pump head of the conventional peristaltic pump along the sectional line A-A in FIG. 1.

Below are results of testing a peristaltic pump using the elastomeric-hose-compressing part as disclosed in the embodiments the present disclosure, a peristaltic pump using roller assembly as disclosed in the embodiments of the present disclosure, and a prior peristaltic pump, wherein #1 represents the prior peristaltic pump comprising a hose-compressing block 106 with a planar compressing surface and rollers 105 with column-shaped rolls as shown in FIG. 2; #2 represents a peristaltic pump with the roller assembly shown in FIGS. 10 and 11 according to the embodiments of the present disclosure; #3 represents a peristaltic pump with the elastomeric-hose-compressing part G shown in FIGS. 4 and 5 according to the embodiments of the present disclosure. In the testing, the compressing surfaces of the #1, #2, and #3 peristaltic pumps have a same width; the liquid as conveyed is water, and the elastomeric hose is a silica gel tube with a 6.4 mm inner diameter and a 9.6 mm outer diameter. The peristaltic pumps under testing have three rollers; under the operating condition of 600 revolutions/minute, the average normal operating durations of respective peristaltic pumps are shown in the table below.

| S/N: | Average Normal Operating Duration (Hour) |
|---|---|
| #1 | 20 hours |
| #2 | 80 hours |
| #3 | 100 hours |

In the depictions of the specification, terms such as "an embodiment," "some embodiments," "an example," "specific examples," o "some examples" mean that specific features, structures, materials or characteristics described in conjunction with the embodiment or example are included in at least one embodiment or example of the present disclosure. In the description, schematic expressions of the above terms do not necessarily refer to the same embodiments or examples. Moreover, the specific features, structures, materials or characteristics as described may be combined in any appropriate way in any one or more embodiments or examples.

Embodiments of the present disclosure have been described above. However, the present disclosure is not limited to the embodiments above. Any modifications, equivalent substitutions, and improvements within the spirit and principle of the present disclosure should be included within the protection scope of the present disclosure.

We claim:

1. An elastomeric-hose-compressing part for a pump head of a peristaltic pump, wherein the elastomeric-hose-compressing part (G) has a surface (1) configured for compressing an elastomeric hose with an arcuate shape along its length direction, wherein the surface (1) for compressing the elastomeric hose is provided with flanges (4) oppositely arranged on two side portions of the elastomeric-hose-compressing part (G) in a width direction, the width direction of the elastomeric-hose-compressing part (G) is perpendicular to the length direction, and the surface (1) is formed by a continuous surface or by a plurality of surfaces sequentially arranged along the length direction; wherein a height h of each flange (4) is not less than a wall thickness of the elastomeric hose, a width of the surface (1) in the width direction of the elastomeric-hose-compressing part (G) is greater than or equal to half of an outer perimeter of a section of the elastomeric hose;

wherein a ratio between the height h of each flange (4) and a width d of each flange (4) in the width direction of the elastomeric-hose-compressing part (G) is in a range of $2 \geq d/h \geq 1/3$, wherein each flange (4) has an inner sidewall (41), a top wall (42), and an outer sidewall (43), the top wall (42) being formed substantially obliquely between the outer sidewall (43) and the inner sidewall (41), the top wall (42) having an arc shape that is convex relative to the surface for compressing the elastomeric hose, and a portion of the top wall (42) proximal to the outer sidewall (43) being higher than a portion of the top wall (42) proximal to the inner sidewall (41), wherein a section of the inner sidewall (41) has a recessed arc shape, a curvature radius of the inner sidewall (41) on the arc section is not less than the electromeric hose wall thickness.

2. The elastomeric-hose-compressing part for a pump head of a peristaltic pump according to claim 1, wherein a width of the top wall (42) is greater than the wall thickness of the elastomeric hose.

3. The elastomeric-hose-compressing part for a pump head of a peristaltic pump according to claim 1, wherein between the inner sidewall (41) and the surface (1) is provided a joining surface with a smooth transition and between the inner sidewall (41) and the top wall (42) is provided a joining surface with a smooth transition.

4. The elastomeric-hose-compressing part for a pump head of a peristaltic pump according to claim 1, wherein the inner sidewall (41) has a shape of a recessed arc having a radius of 1-2.5 times the wall thickness of the elastomeric hose, and the inner sidewall (41) is tangent with the surface (1) for compressing the elastomeric hose.

5. The elastomeric-hose-compressing part for a pump head of a peristaltic pump according to claim 1, wherein a ratio between the height h of each flange (4) and the width d of the flange (4) in the width direction of the elastomeric-hose-compressing part (G) is in a range of $2 \geq d/h \geq 1/2$.

6. A cartridge for a pump head of a peristaltic pump, comprising: a cartridge body (7) and a snap-fitting part (71, 72); at a lower side of a transverse beam (73) of the cartridge body (7) is provided the elastomeric-hose-compressing part (G) according to claim 1; and the snap-fitting part (71, 72) is adapted to detachably mount the cartridge to the pump head of the peristaltic pump.

* * * * *